United States Patent [19]

Swaffield

[11] Patent Number: 4,582,388

[45] Date of Patent: Apr. 15, 1986

[54] HIGH VOLTAGE SNAP ON COUPLING

[75] Inventor: John D. Swaffield, Brockton, Mass.

[73] Assignee: Alden Research Foundation, Brockton, Mass.

[21] Appl. No.: 485,612

[22] Filed: Apr. 18, 1983

[51] Int. Cl.[4] ..... H01R 11/22

[52] U.S. Cl. ..... 339/258 TC; 264/272.11; 339/61 C; 339/102 R; 339/258 R

[58] Field of Search ..... 264/272.11; 339/258 R, 339/218 R, 218 M, 102 R, 61 R, 61 C, 111, 258 TC

[56] References Cited

U.S. PATENT DOCUMENTS

| | | | |
|---|---|---|---|
| 3,251,018 | 5/1966 | Bennett | 264/272.11 |
| 3,668,779 | 6/1972 | Turner | 264/272.11 |
| 3,725,846 | 4/1973 | Strain | 339/61 R |
| 4,204,741 | 5/1980 | Hall | 339/258 TC |
| 4,382,650 | 5/1983 | Herrmann, Jr. | 339/97 R |
| 4,398,785 | 8/1983 | Hedrick | 264/272.11 |
| 4,418,171 | 11/1983 | Hall | 339/258 TC |

*Primary Examiner*—Gil Weidenfeld
*Assistant Examiner*—Paula Austin
*Attorney, Agent, or Firm*—James H. Grover

[57] ABSTRACT

A high voltage CRT anode electrical coupling has a connector with several spring contact fingers extending from a base and an insulating ring around the connector between the base and fingers. An insulative shroud is molded around ring and base leaving the fingers unconfined.

11 Claims, 5 Drawing Figures

HIGH VOLTAGE SNAP ON COUPLING

BACKGROUND OF THE INVENTION

High voltage connectors such as a snap on coupling to a cathode ray tube (CRT) terminal include an insulated wire cable soldered to a conductive connector and an insulative shroud around the cable and conductor. Typically the shroud is formed of plastic and then the cable and attached connector are manually inserted in the shroud. Such an assembled coupling leaves air spaces between the cable-connector parts and the shroud where arc discharges may develop extending to the exterior of the coupling or inducing electrical noise. The cable must be inserted into the shroud through a passage which might be loose fitting to facilitate assembly. Consequently a leakage path exits along the passage and the cable is not secured to the shroud. Similarly the connector is loosely held and subject to being pulled out of the shroud by the CRT or other terminal when disconnection of the coupling is attempted. Also assembly of the cable-connector and shroud, a manual operation, adds substantially to the expense of manufacture.

It has been desirable to mold the shroud around the cable and connector, but because the connector is shaped with multiple spaced spring fingers, hitherto no way of molding a shroud around the spaced fingers has been available because the molding compound, particularly in injection molding, tends to flash through the spring fingers and clog or insulate them.

Accordingly it is an object of the present invention to provide a coupling with a shroud molded around the connector and cable which eliminates the assembly step, which is relatively free of arcing and leakage and which resists dislodgement of the cable or connector.

STATEMENT OF INVENTION

According to the invention a high voltage electrical coupling comprises a conductive connector with a plurality of separated spring contact fingers adapted to engage in a mating connector and extending from a common base connected to a cable; an annular insulating member around the connector between the fingers and the base; and an insulative shroud molded around the insulating member, the base and the cable with the spring fingers substantially unconfined.

DRAWING

DESCRIPTION

Figure 1:
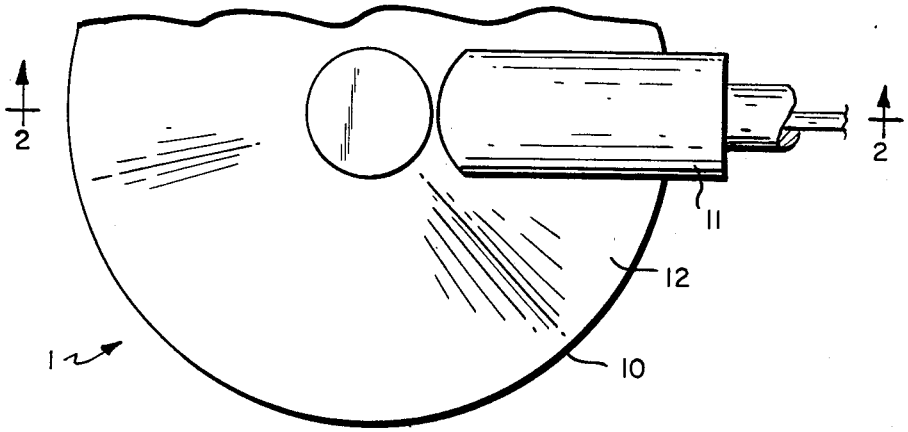
FIG. 1 is a top view of a high voltage coupling according to the invention.
Figure 2:
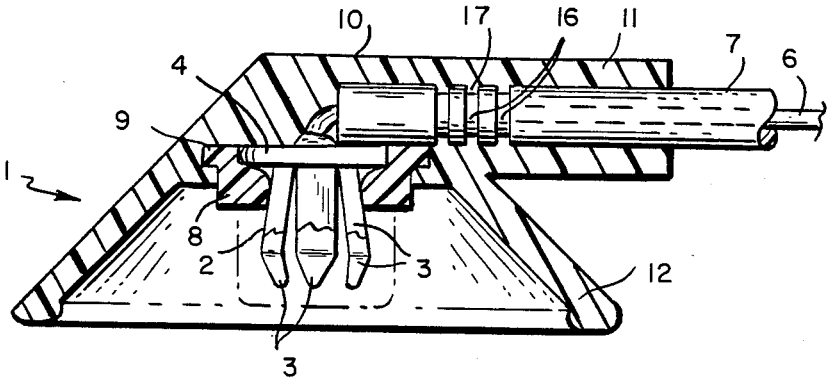
FIG. 2 is a section on line 2—2 of FIG. 1.

Shown in FIGS. 1 and 2 is a plug type of high voltage coupling 1 for connection to a socket type of terminal on a cathode ray tube (e.g. Jedec J1-21 connector) although the plug and socket could be reversed. As is typical such couplings include a conductive connector 2 with multiple, here six, spring fingers 3 extending from a disk-shaped base 4. Soldered to the base 4 is the wire conductor 6 of a cable with insulation 7. Immediately surrounding the connector is an annular insulating member 8. The connector annular member may deviate from circular form. Around the connector and annular member is a molded shroud 10 having a cable entrance tube 11 and a flared skirt 12 covering the connector 2.

The spring fingers 3 of the conductive plug type or male connector 2 may be stamped from a springy metal integrally and coaxially with their base 4. The fingers are split and spaced apart, and are curved or bent non-cylindrically with respect to the axis of the connector. This non-cylindrical split form presents a problem in molding the shroud, particularly in high pressure injection molding. Because it is non-cylindrical the connector is not easily protected during molding. The molding plastic also would tend to flash through the splits between fingers.

But according to the present invention the annular member is located around the multi-fingered connector between the fingers 3 and the base 4 leaving the fingers free flexing.

The annular member 8 has a flange 9 embedded in the shroud. The member and shroud may be of compatible elastomers bonded to each other, more securely to anchor the member in the shroud. The member 8 also has a shoulder 5 extending over the connector base 4 and facing inwardly of the shroud to anchor the connector in the shroud without confining the spring fingers 3. Such anchoring is not possible with couplings assembled after molding of the shroud.

The insulation 7 over the wire 6 has annular peripheral grooves 16 filled by annular lands 17 of the shroud 10. The interfitting lands and grooves grip the cable in the shroud and greatly reduce arcing and leakage along the cable even if its insulation is incompatible with that of the shield. This interfitting also is not possible with couplings assembled after molding of the shroud.

Figure 3:
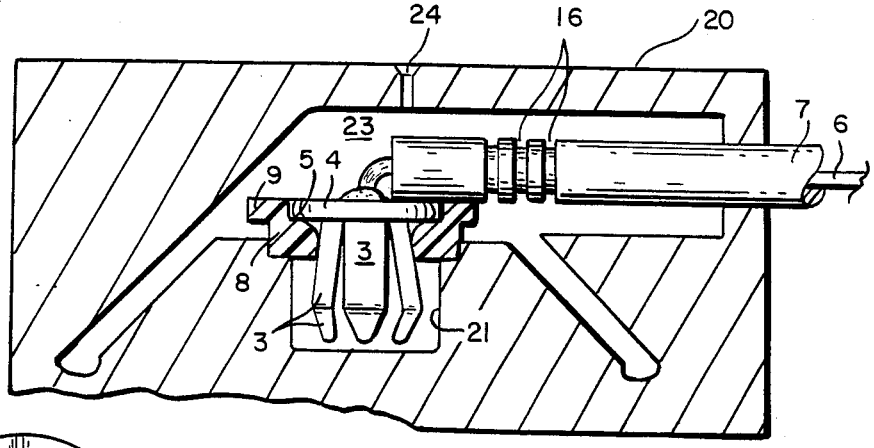
FIG. 3 is a sectional view of a mold for enshrouding the coupling.
Figure 4:
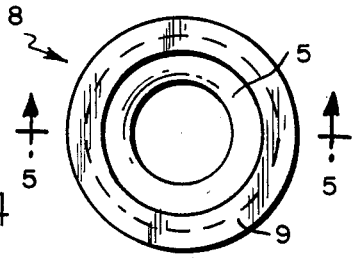
FIG. 4 is a top view of an annular member of the coupling.
Figure 5:
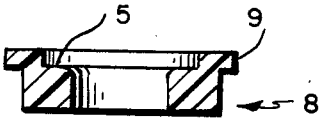
FIG. 5 is a section of the member on line 5—5 of FIG. 4.

As shown in FIG. 3 prior to molding the annular member 8 is fitted around the connector 2 between the fingers 3 and the base 4 so that a shoulder 5 on the member faces and seals against the base 4 and held there by its resilient grip of the roots of the flaring, non-cylindrical, spaced fingers. The member 8, connector 2 and cable 6, 7 are then placed in a mold 20 with the member 8 seating in a socket 21 of the mold. The socket surrounds the fingers extending from one side of the member and the member seals off the socket and fingers from the mold cavity 23 into which fluid insulative material is injected through a gate 24. The pressure of the injected material whether high or low assists in sealing the member in the mold socket and expels air from the other cavity 23 side of the members completely replacing the air with insulative material so as to eliminate arcing space as well as forming the ridges 17 extending into the grooves 16 of the insulation 11.

It should be understood that the present disclosure is for the purpose of illustration only and that this invention includes all modifications and equivalents which fall within the scope of the appended claims.

I claim:

1. A high voltage electrical coupling comprising:

a conductive connector with a plurality of separated spring contact fingers adapted to engage in a mating connector and extending from a common disk-shaped base connected to a cable;

an annular insulating member around the connector between the fingers and the base and pressed flatwise against the base so as to form a seal between the base and fingers; and an insulative shroud of pressure-injection material molded around the insulating member, the base and the cable with the spring fingers substantially unconfined.

2. A coupling according to claim 1 wherein the shroud is of elastomeric material.

3. A coupling according to claim 1 wherein the shroud wholly contacts the connector with no substantial intervening air space.

4. A coupling according to claim 1 wherein the shroud is of injection molded material.

5. A coupling according to claim 1 wherein the annular insulating member is of elastomeric material.

6. A coupling according to claim 5 wherein the elastomeric material of the annular member is bonding-compatible with the material of the shroud.

7. A coupling according to claim 1 wherein the annular insulating member has a flange embedded in the shroud and opposing withdrawal of the connector from the shroud.

8. A coupling according to claim 7 wherein the shroud extends over the connector base to the spring fingers.

9. A coupling according to claim 1 including an insulated cable connected to the connector.

10. A coupling according to claim 9 wherein the insulation of the cable has a circumferential groove, and the shroud extends into the groove.

11. The method of molding insulation on an assembly of a cable attached to a connector having spring fingers extending from a base comprising:

fitting an annular member of resilient insulation around the connector between the fingers and the base, sealing the member in a socket of a mold with the fingers extending from one side of the member into the socket; and injecting insulative material into the mold onto the other side of the member thereby to seal the member in the socket and exclude insulative material from the fingers while expelling air from within the mold on the other side of the member.

* * * * *